US005957569A

United States Patent [19]

Helbig et al.

[11] Patent Number: 5,957,569

[45] Date of Patent: Sep. 28, 1999

[54] ELECTRIC LAMP WITH CEMENT-FREE BASE AND METAL/PLASTIC REFLECTOR-TYPE SOCKET WITH SPRING

[75] Inventors: Peter Helbig, Sontheim; Hermann Steiner, Herbrechtingen, both of Germany

[73] Assignee: Patent-Treuhand-Gesellschaft fuerelektrische Gluehlampen mbH, Munich, Germany

[21] Appl. No.: 08/913,166

[22] PCT Filed: Oct. 17, 1996

[86] PCT No.: PCT/DE96/01982

§ 371 Date: Sep. 9, 1997

§ 102(e) Date: Sep. 9, 1997

[87] PCT Pub. No.: WO97/25733

PCT Pub. Date: Jul. 17, 1997

[30] Foreign Application Priority Data

Jan. 11, 1996 [DE] Germany ..... 196 00 714

[51] Int. Cl.[6] ..... F21K 27/00

[52] U.S. Cl. ..... 362/263; 362/226; 362/440; 362/444; 362/437; 362/443

[58] Field of Search ..... 362/226, 440, 362/444, 437, 443

[56] References Cited

U.S. PATENT DOCUMENTS

| | | | |
|---|---|---|---|
| 1,139,684 | 5/1915 | Humphrey | 362/440 |
| 4,412,273 | 10/1983 | Helbig et al. | 362/211 |
| 4,473,770 | 9/1984 | Baba et al. | 313/318 |
| 4,682,274 | 7/1987 | Freudenreich et al. | 362/226 |
| 4,751,421 | 6/1988 | Braun et al. | 313/318 |

FOREIGN PATENT DOCUMENTS

| | | |
|---|---|---|
| 205773 | 1/1984 | Germany . |
| 3344356 | 6/1985 | Germany . |
| 245347 | 5/1987 | Germany . |
| 8907108 | 9/1989 | Germany . |
| 2223300 | 4/1990 | United Kingdom . |

*Primary Examiner*—Sandra O'Shea
*Assistant Examiner*—Ronald E. DelGizzi
*Attorney, Agent, or Firm*—William E. Meyer

[57] ABSTRACT

The invention relates to an electric lamp based without cement, for installation in a reflector which is provided with an opening (17*a*) and made in the reflector wall (17). The lamp has a metal/plastic base which has a metal holder part (12) in which the bulb (10) of the lamp is fixed, a metal support sleeve (13) which is connected to the metal holder part (12), and a plastic base part (14) which is provided with the electrical connections (15) of the lamp and in which the support sleeve (13) is anchored. The lamp base has a plurality of reference lugs (14*a*), lying in a plane, which are used for holding and for correct installation of the lamp in the reflector. According to the invention, the plastic reference lugs (14*a*) are covered by metal cover tabs (13*b*) so that reference lugs (14*a*) are screened against the electromagnetic radiation generated by the lamp, or alternatively the reference lugs (43*b*) are made of metal.

21 Claims, 8 Drawing Sheets

ELECTRIC LAMP WITH CEMENT-FREE BASE AND METAL/PLASTIC REFLECTOR-TYPE SOCKET WITH SPRING

TECHNICAL FIELD

The invention relates to electric lamps and particularly to vehicle lamps. More particularly the invention is concerned with a replaceable vehicle lamp.

BACKGROUND ART

The invention relates to an electric lamp based without cement. An electric lamp based without cement is disclosed in U.S. Pat. No. 4,412,273. The lamp described therein is a single base incandescent halogen lamp for use in a motor-vehicle headlight. The lamp in U.S. Pat. No. 4,412,273 consists of a lamp base made of metal and plastic parts. The lamp base has a cup-like metal fastening ring, a metal support sleeve and a plastic base which is provided with the electrical connections for the lamp. The support sleeve protrudes telescopically out of the base in which it is anchored, and is welded to the fastening ring using a plurality of integrally formed welding tabs. The fastening ring has a recess in which the end of the pinch of the lamp bulb is fixed. The plastic base has an annular flange and an alignment plate. Between the flange and the alignment plate, there is an annularly extending groove for receiving a gasket which seals off the reflector opening. The alignment plate ends approximately at the inner side of the reflector.

A disadvantage of the lamp in U.S. Pat. No. 4,412,273 is that the plastic alignment plate for the base is directly exposed to the infrared radiation emitted by the lamp. Because the plastic tends to give off vapors when heated, exposure of the plastic alignment plate to the infrared radiation results in fogging of the reflector. Furthermore, the plastic has a comparatively high coefficient of thermal expansion, so that heating the alignment plate by the infrared radiation generated by the lamp causes a misalignment of the light source. In addition, the telescopic design of the support sleeve has the disadvantage that the lamp has a comparatively large overall length and requires correspondingly deep reflectors.

DISCLOSURE OF THE INVENTION

The object of the invention is to provide an electric lamp, having an improved lamp base for installation in a reflector wherein the improved lamp base is based without cement.

The electric lamp, based without cement, is intended for installation in a reflector, for example the reflector of a motor-vehicle headlight. The lamp has a lamp base made of metal and plastic parts. The lamp base has a metal holder part in which the lamp bulb is fixed, a metal support sleeve supporting the holder part and a plastic base part which is provided with the electrical connections of the lamp and in which the support sleeve is anchored.

The plastic base part has a plurality of reference lugs, located in a common plane, which on the one hand are used for holding the lamp in the reflector, and on the other hand are used to determine the position of the light source in the reflector and define the reference plane for aligning the light source when the lamp base is being fitted in place. The plastic reference lugs engage the reflector opening, which is formed as a lamp socket, and according to the invention each lug is covered by a cover tab, integrally formed on the metal support sleeve, so that the reference lugs are screened against the electromagnetic radiation generated by the lamp, and in particular against infrared radiation. For this purpose the cover tabs preferably cover the upper sides of the reference lugs facing the lamp bulb. The cover tabs prevent, on the one hand, the plastic reference lugs from giving off vapors and fogging the reflector and, on the other hand, the light source from migrating from its originally exactly adjusted position as a result of the thermal expansion of the reference lugs. The metal cover tabs have a much lower thermal expansion as well as higher stiffness than the plastic reference lugs, and prevent thermally induced deformation of the reference lugs and the concomitant misalignment of the light source in the reflector. The reference lugs then give the lamp base greater mechanical stability, particular when heated.

In another embodiment of the invention, the object of the invention is achieved in that the reference lugs which engage in the reflector opening are made of metal and are formed integrally with the metal support sleeve. The lamp base as a result has greater mechanical stability preventing misalignment of the light source in the reflector due to the thermal expansion of the lamp cap.

The support sleeve is preferably made of steel or nickel silver (German silver). Both thermoplastics and thermosetting plastics are appropriate for the plastic base part.

Preferably, the metal support sleeve of the lamp is annularly designed and is matched to the engagement diameter of the reflector opening, and is also provided with at least one pressure spring which bears on the reflector wall after the lamp has been installed in the lamp socket of the reflector. The pressure spring ensures that the lamp is seated firmly in the lamp socket of the reflector and compensates for slight tolerances in the manufacture of the lamp base and of the reflector opening. The pressure spring is preferably designed as a bent leaf spring. According to a preferred embodiment of the invention, one end of the leaf spring is welded to the metal support sleeve, while the other end bears on the lamp base so that the end of the spring can slide. The leaf spring then bears resiliently on the edge of the reflector opening after the lamp has been installed. In another preferred embodiment, the ends of the leaf spring are each arranged in a hollow recess between the metal support sleeve and the plastic base part, so that the leaf spring bears resiliently on the edge of the reflector opening after the lamp has been installed. The pressure spring is preferably made of a spring steel.

The plastic base part is generally produced by using an injection-molding process. The metal support sleeve is preferably either injected into the plastic base part or anchored in the plastic base part by catch or snap fastenings.

The holder part is preferably connected to the support sleeve via an intermediate ring which is provided with integrally formed welding tabs that are preferably formed at an angle to the support sleeve. The welding tabs of the intermediate ring are then preferably welded to the cover tabs integrally formed on the support sleeve or to the metal reference lugs. The intermediate ring provides two additional degrees of freedom for the alignment of the light source, so that a five-axis alignment of the light source is made possible. The plastic base part has an annularly extending, preferably tapered groove for receiving a gasket. The internal diameter of the gasket is preferably accurately matched to the circular, tapered groove and varies linearly with the height of the gasket. These measures ensure that the gasket is seated without play on the plastic base part and cannot fall off the base. The lamp base of the electric lamp according to the invention combines the advantages of a metal base providing small manufacturing tolerances and the possibility of exact alignment for the light source, with the advantages of a plastic base providing inexpensive manufacture and simple sealing of the base. The invention will be explained in more detail below with the aid of several preferred embodiments.

BEST MODE FOR CARRYING OUT THE INVENTION

Figure 1:
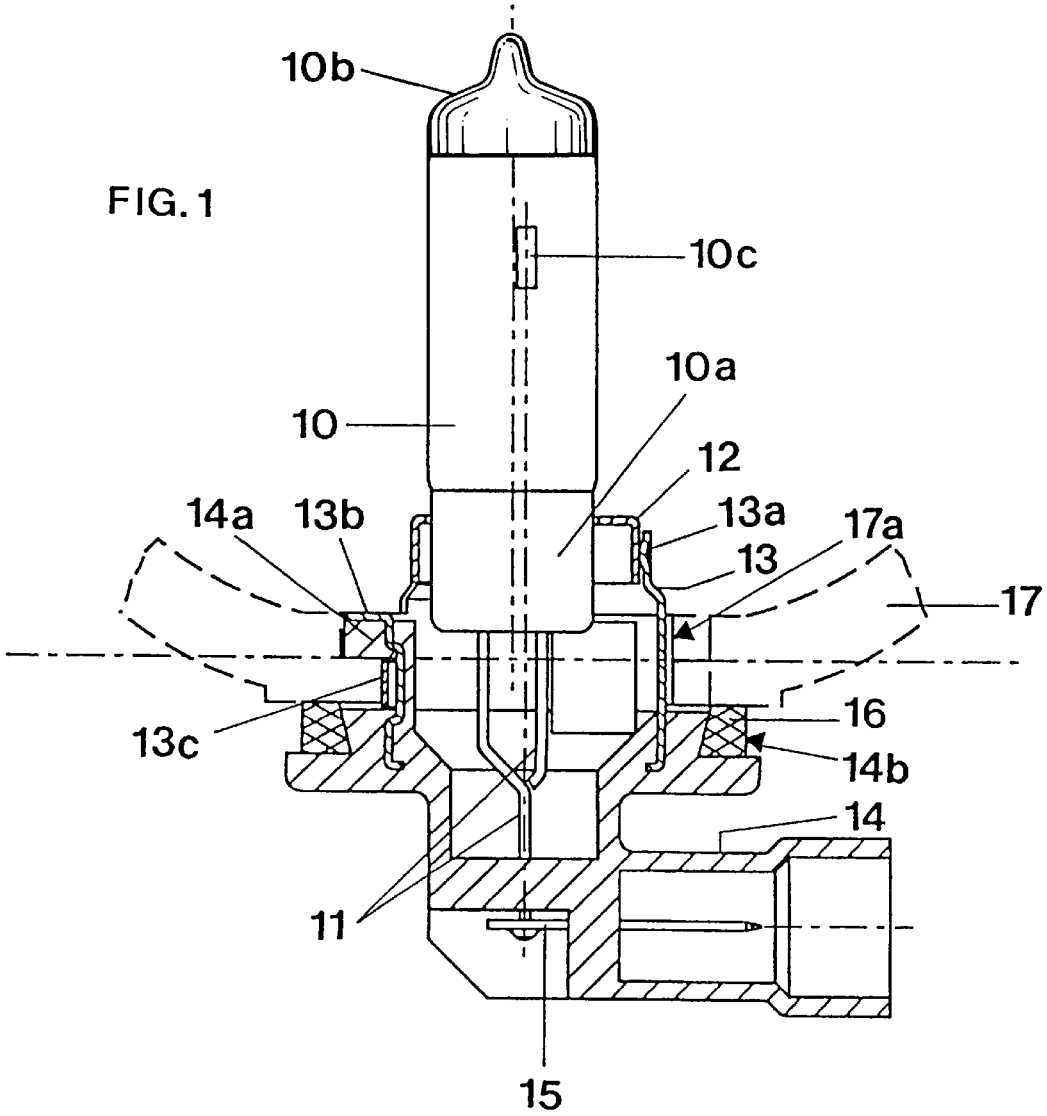
FIG. 1 shows a schematized side view of a preferred electric lamp, based without cement, in partially sectional representation.
Figure 2:
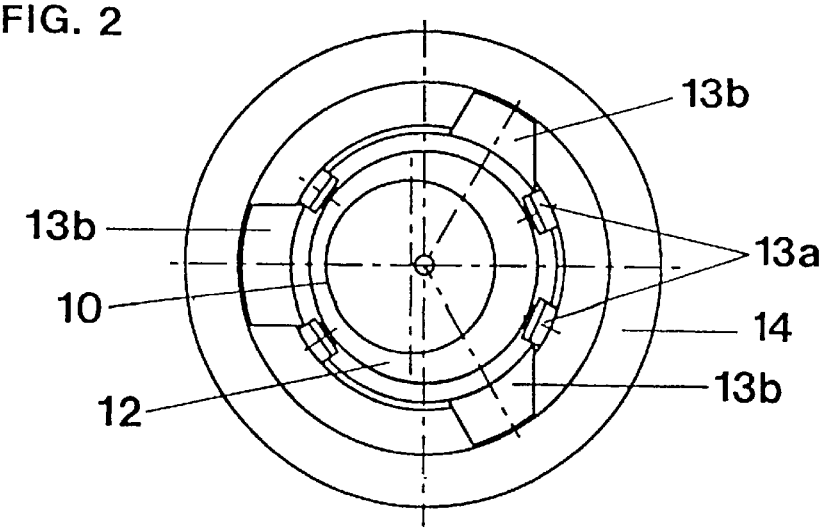
FIG. 2 shows a plan view of the lamp of FIG. 1.
Figure 7:
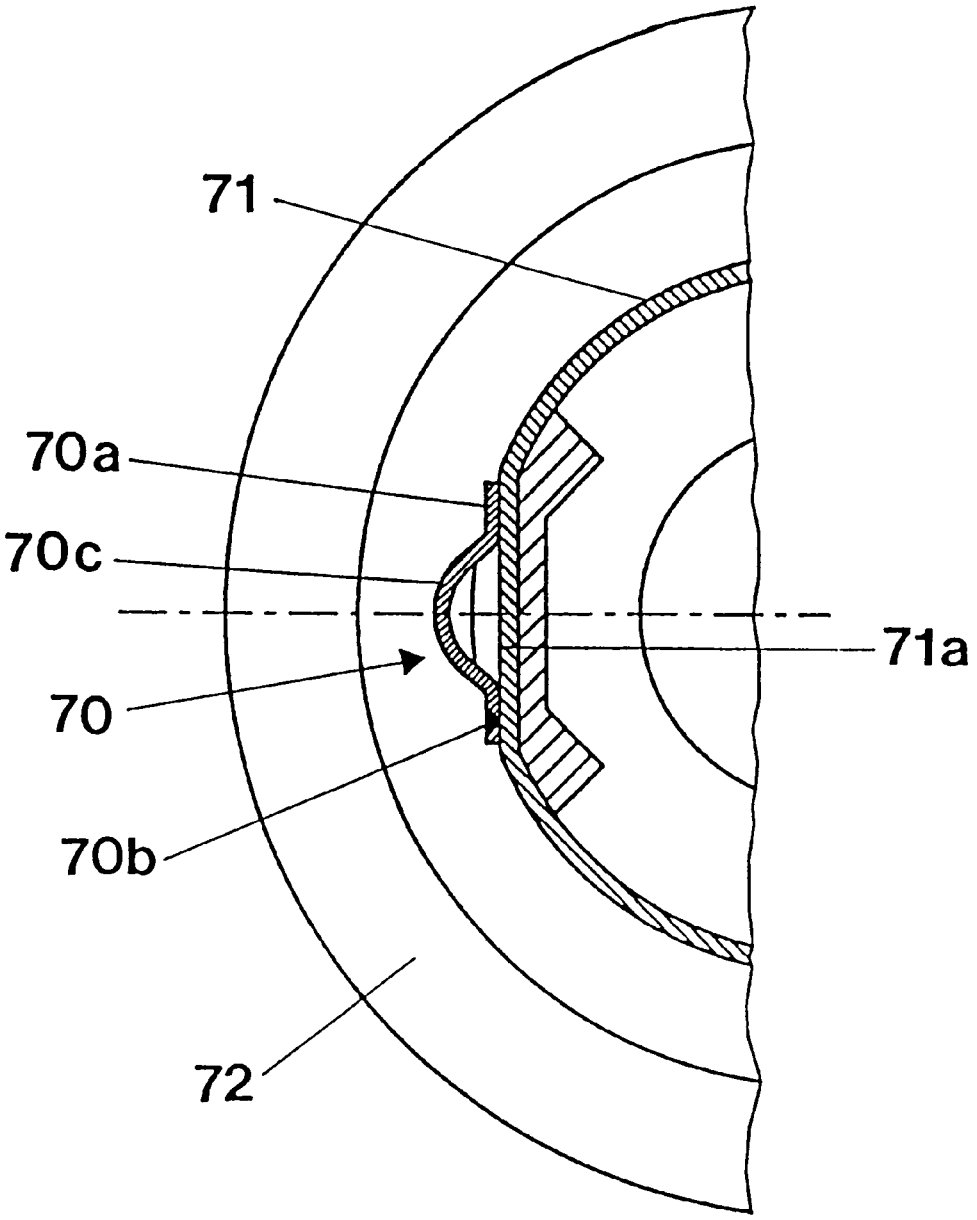
FIG. 7 shows a first embodiment for a preferred pressure spring of the lamp.
Figure 8:
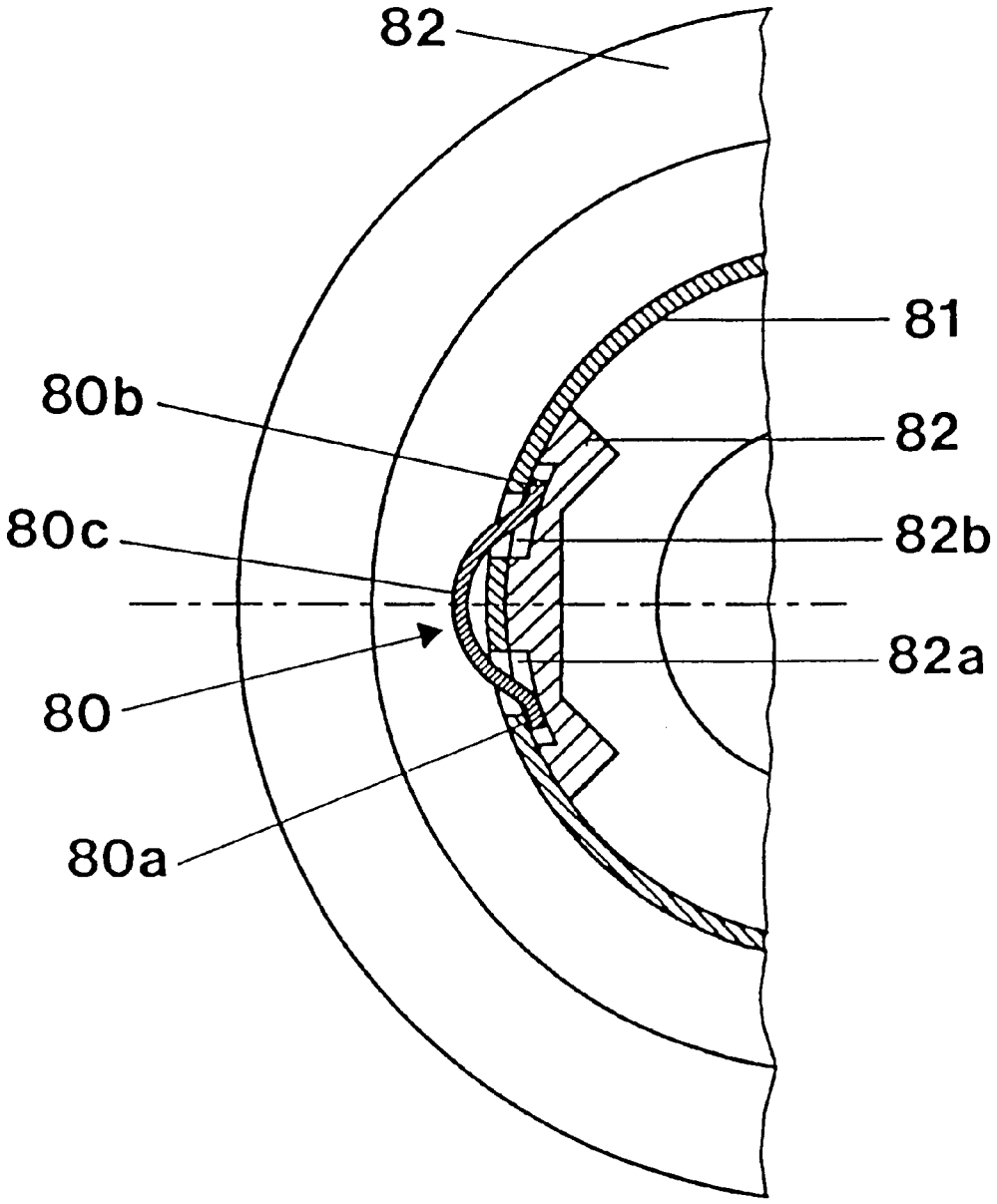
FIG. 8 shows a second embodiment for a pressure spring.

The first preferred embodiment of the lamp based without cement according to the invention (FIGS. 1 and 2) is a single-filament incandescent halogen lamp which is intended for use in a motor-vehicle headlight. This lamp has an essentially cylindrical glass lamp bulb 10 with a pinch-sealed lamp bulb end 10*a* which is generally referred to as the pinch end 10*a*. The dome 10*b* of the lamp bulb 10 is provided with a black, light-absorbing coating. The light source used is an incandescent filament 10*c*, aligned parallel to the axis of the lamp bulb and electrically connected to electrical supply leads 11 lead out from the pinch end 10*a*. The lamp bulb 10 is fixed via its pinch end 10*a* in a metal holder part 12 designed as a fastening ring. The fastening ring 12 is supported by an annular metal support sleeve 13. The support sleeve 13 has four integrally formed welding tabs 13*a* which are spot-welded or laser-welded to the fastening ring 12. In addition to the metal fastening ring 12 and the metal support sleeve 13, the lamp base also has a plastic base part 14 which is provided with the electrical connections 15 of the lamp and in which the support sleeve 13 is anchored. The electrical connections 15 of the lamp are each welded to one of the electrical supply leads 11. The plastic base part 14 is an injection-molded part into which the metal support sleeve 13 is injected. The plastic base part 14 has three integrally formed reference lugs 14*a*, arranged equidistantly along a circumference, which are used for aligning the incandescent filament 10*c* and for fastening the lamp in the reflector 17 of the headlight. The reference lugs 14*a*, engage in the opening 17*a* formed in the reflector 17 as a lamp socket. The reference lugs 14*a* are each covered by a cover tab 13*b* integrally formed on the support sleeve 13 and formed at an angle therefrom, and are thus screened against the infrared radiation generated by the incandescent filament 10*c*. For this purpose the cover tabs 13*b* cover the upper sides of the reference lugs 14*a* facing the lamp bulb. The plastic base part 14 furthermore has an annularly extending, tapered groove 14*b*, in which a rubber or silicone gasket 16 is arranged. The gasket 16 bears on the outside of the reflector wall 17 and seals off the reflector opening 17*a*. The internal diameter of the gasket 16 is accurately matched to the tapered groove 14*b* and varies linearly with the gasket height. The plastic base part 14 is plugged with a sealing compound which seals off the lamp base at the electrical supply leads 11. The three reference lugs 14*a*, the gasket 16 and a pressure spring 13*c*, integrally formed below a reference lug 14*a* on the metal support sleeve 13, are used for fastening the lamp in the correct position in the lamp socket 17*a* of the reflector. The lamp base and the lamp socket 17*a* form a bayonet connection. To install the lamp in the reflector, the lamp is inserted, with the lamp bulb 10 forwards, into the reflector opening 17*a*, the three reference lugs 14*a* each engaging through a matched recess in the edge of the opening 17*a*. The lamp is then rotated in the lamp socket until the lamp reaches a stop (not shown), so that the reflector 17 is clamped between the reference lugs 14*a* and the gasket 16. The pressure spring 13*c* bears resiliently on the edge of the reflector opening 17*a*. To prevent erroneous installation of the lamp in the reflector, one of the three reference lugs 14*a* has a different shape from the other two reference lugs 14*a*. The same is also true for the recesses in the opening 17*a* which are matched to the reference lugs 14*a*. Details of the pressure spring 13*c* are represented in FIGS. 7 and 8.

Figure 3:
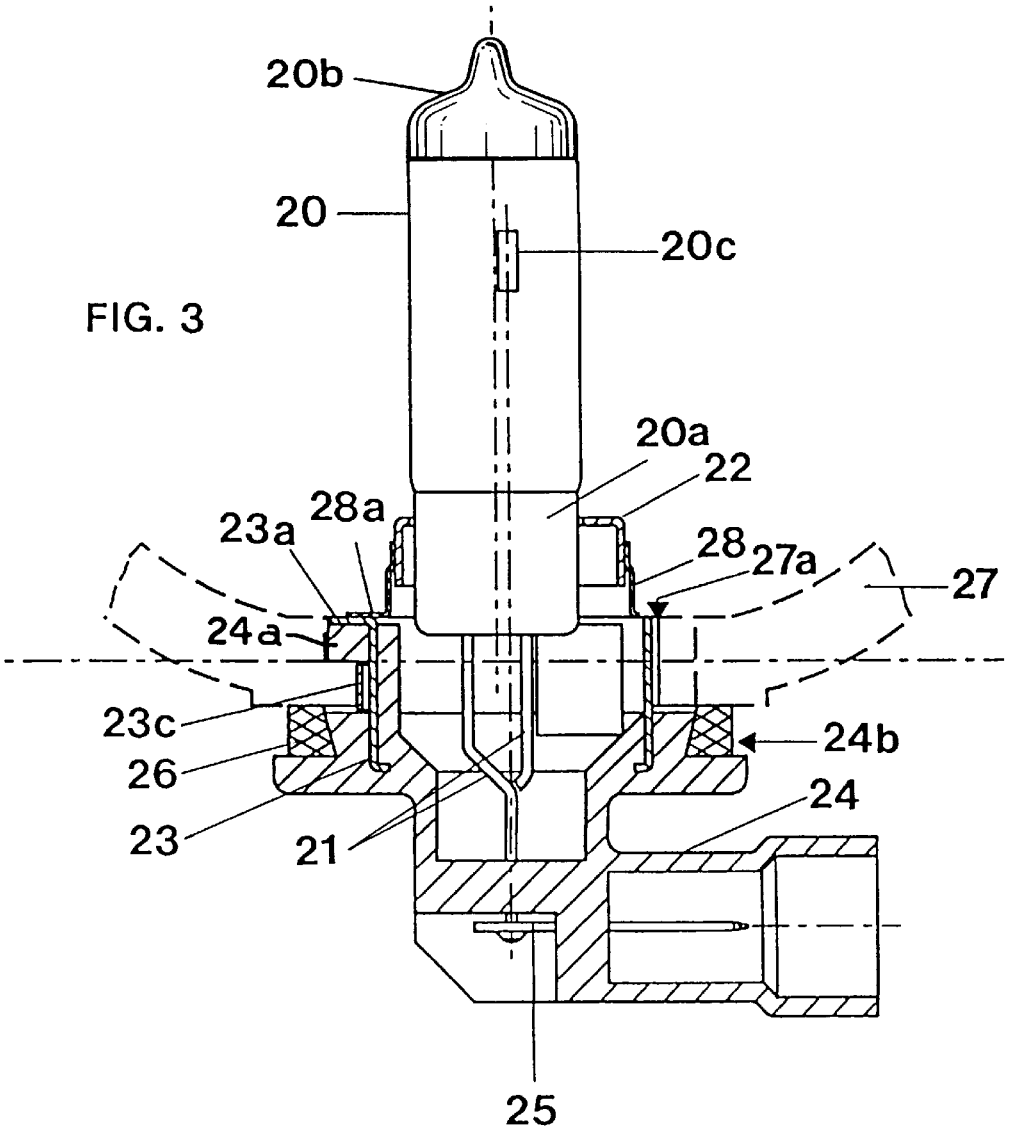
FIG. 3 shows a schematized side view of an alternatively preferred electric lamp, based without cement, according to the second preferred embodiment of the invention, in partially sectional representation.
Figure 4:
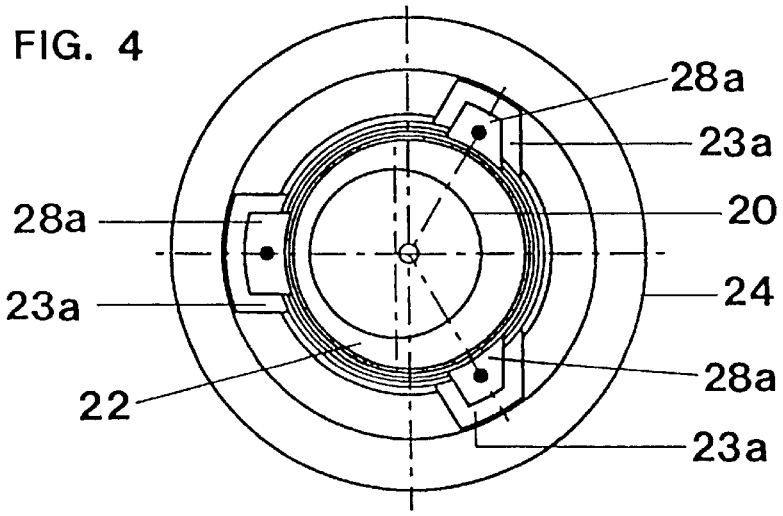
FIG. 4 shows a plan view of the lamp of FIG. 3.

A second preferred embodiment of the invention is schematically represented in FIGS. 3 and 4. This second embodiment differs from the first embodiment essentially only by an intermediate ring 28 which is inserted as an additional base component and connects the fastening ring 22 to the support sleeve 23. The second preferred embodiment of the lamp based without cement according to the invention is likewise a single-filament incandescent halogen lamp which is intended for use in a motor-vehicle headlight. This lamp has an essentially cylindrical glass lamp bulb 20 with a pinch-sealed lamp bulb end 20*a* which is generally referred to as a pinch end 20*a*. The dome 20*b* of the lamp bulb 20 is provided with a black light-absorbing coating. The light source used is an incandescent filament 20*c*, aligned parallel to the axis of the lamp bulb, which is electrically connected to electrical supply leads 21 led out from the pinch end 20*a*. The lamp bulb 20 is fixed by its pinch end 20*a* in a metal holder part 22 designed as a fastening ring. The fastening ring 22 is supported by a metal intermediate ring 28 which is provided with three integrally formed welding tabs 28*a*, and formed at an angle thereto. The three welding tabs 28*a* of the intermediate ring 28 are each laser-welded to a cover tab 23*a* of an annular metal support sleeve 23. In addition to the metal fastening ring 22, the intermediate ring 28 and the metal support sleeve 23, the lamp base also has a plastic base part 24 which is provided with the electrical connections 25 of the lamp and in which the support sleeve 23 is anchored. The electrical connections 25 of the lamp are each welded to one of the electrical supply leads 21. The plastic base part 24 is an injection-molded part into which the metal support sleeve 23 is injected. The plastic base part 24 has three integrally formed reference lugs 24*a*, arranged equidistantly along a circumference, which are used for aligning the incandescent filament 20*c* and for fastening the lamp in the reflector 27 of the headlight. The reference lugs 24*a*, which engage in the opening 27*a* of the reflector 27 which is, are each covered by a cover tab 23*a*, integrally formed on the support sleeve 23 and formed at an angle therefrom, and thus screened against the infrared radiation generated by the incandescent filament 20*c*. The welding tabs 28*a* of the intermediate ring 28 are laser-welded to these cover tabs 23*a* (FIG. 4). The intermediate ring 28 provides additional possibilities for alignment in the reference plane defined by the reference lugs 24*a*. The plastic base part 24 furthermore has an annularly extending, tapered groove 24*b* in which a rubber or silicone gasket 26 is arranged. The gasket 26 bears on the outside of the reflector wall 27 and seals off the reflector opening 27*a*. The internal diameter of the gasket 26 is accurately matched to the tapered groove 24*b* and varies linearly with the gasket height. The plastic base part 24 is plugged with a sealing compound which seals off the lamp base at the electrical supply leads 21. The three reference lugs 24*a*, the gasket 26 and three pressure springs 23*c*, integrally formed below the reference lugs 24*a* on the metal support sleeve 23, are used for fastening the lamp in the lamp socket 27*a* of the reflector. The lamp base and the lamp socket 27*a* form a bayonet connection. To install the lamp in the reflector, the lamp is inserted, with the lamp bulb 20 forwards, into the reflector opening 27*a*, the three reference lugs 24*a* each engaging through a matched recess in the edge of the opening 27*a*. The lamp is then rotated in the lamp socket until it meets a stop, so that the reflector wall 27 is clamped between the reference lugs 24*a* and the gasket 26. The pressure spring 23*c* bear resiliently on the edge of the reflector opening 27*a*. To prevent erroneous installation of the lamp in the reflector, one of the three reference lugs 24*a* has a different shape from the other two reference lugs 24*a*. The same is also true for the recesses in the opening 27*a*, which are matched to the reference lugs 24*a*. Details of example pressure springs, such as pressure spring 23*c*, are represented in FIGS. 7 and 8 by springs 70 and 80.

Figure 5:
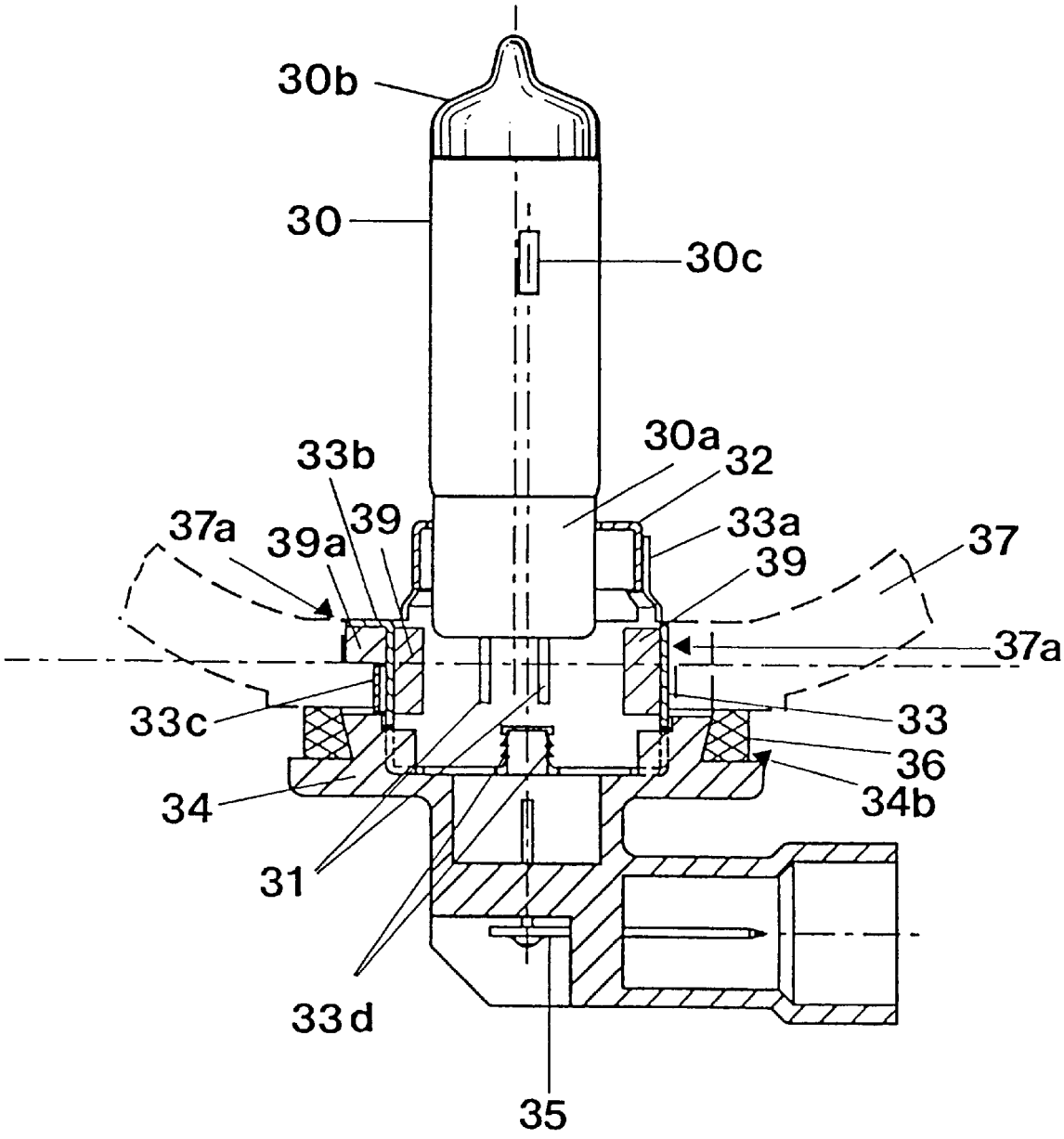
FIG. 5 shows a schematized side view of a second alternative electric lamp, based without cement, in partially sectional representation.

FIG. 5 shows a third preferred embodiment of the lamp based without cement according to the invention. Like the lamp in the first embodiment, this lamp is a single-filament incandescent halogen lamp, equipped with a metal/plastic cap, to be used in the reflector of a motor-vehicle headlight. This lamp has an essentially cylindrical glass lamp bulb 30 with a pinch-sealed lamp-bulb end 30*a* which is generally referred to as the pinch end 30*a*. The dome 30*b* of the lamp bulb 30 is provided with a black light-absorbing coating. The light source used is an incandescent filament 30*c*, aligned parallel to the axis of the lamp bulb, which is electrically connected to electrical supply leads 31 led out from the pinch end 30*a*. The lamp bulb 30 is fixed via its pinch end 30*a* in a metal holder part 32 designed as a fastening ring. The fastening ring 32 is supported by an annular metal support sleeve 33. The support sleeve 33 has four integrally formed welding tabs 33*a*, which are spot-welded or laser-welded to the fastening ring 32. In addition to the metal fastening ring 32 and the metal support sleeve 33, the lamp base also has a plastic base part 34 which is provided with the electrical connections 35 of the lamp and in which the support sleeve 33 is anchored. The electrical connections 35 of the lamp are each welded to one of the electrical supply leads 31. The plastic base part 34 is an injection-molded part, into which the metal support sleeve 33 is fitted. The metal support sleeve 33 is provided with a plurality of claws 33*d* which dig into the plastic base part 34 when the support sleeve 33 is fitted, and thus make a permanent connection between the plastic base part 34 and the support sleeve 33. The metal support sleeve 33 is injected into a molded part 39 which is made of a plastic which can withstand higher thermal loading than the plastic base part 34. In contrast to the first two preferred embodiments, the plastic base part 34 does not engage in the opening 37*a* of the reflector wall 37 which is, but ends on the outside of the reflector wall 37. The plastic molded part 39 has three integrally formed reference lugs 39*a*, arranged equidistantly along a circumference, which are used for aligning the incandescent filament 30*c* and for fastening the lamp in the reflector of the headlight. The reference lugs 39*a*, which engage in the opening 37*a* of the reflector wall 37 which is, are each covered by a cover tab 33*b*, integrally formed on the support sleeve 33 and formed at an angle therefrom, and thus screened against the infrared radiation generated by the incandescent filament 30*c*. The plastic base part 34 has an annularly extending, tapered groove 34*b*, in which a rubber or silicone gasket 36 is arranged. The gasket 36 bears on the outside of the reflector wall 37 and seals off the reflector opening 37*a*. The internal diameter of the gasket 36 is accurately matched to the tapered groove 34*b* and varies linearly with the gasket height. The plastic base part 34 is plugged with a sealing compound which seals off the lamp base at the electrical supply leads 31. The three reference lugs 39*a*, the gasket 36 and a pressure spring 33*c*, integrally formed below a reference lug 39*a* on the metal support sleeve 33, are used for fastening the lamp in the lamp socket 37*a* of the reflector. The lamp base and the lamp socket 37*a* form a bayonet connection. To install the lamp in the reflector, the lamp is inserted, with the lamp bulb 30 forwards, into the reflector opening 37*a*, the three reference lugs 39*a* each engaging through a matched recess in the edge of the opening 37*a*. The lamp is then rotated in the lamp socket until it meets a stop, so that the reflector wall 37 is clamped between the reference lugs 39*a* and the gasket 36. The pressure spring 33*c* bears resiliently on the edge of the reflector opening 37*a*. To prevent erroneous installation of the lamp in the reflector, one of the three reference lugs 39*a* has a different shape from the other two reference lugs 39*a*. The same is also true for the recesses in the opening 37*a*, which are matched to the reference lugs 39*a*. Details of example pressure springs, such as pressure spring 33*c*, are represented in FIGS. 7 and 8 by springs 70 and 80.

Figure 6:
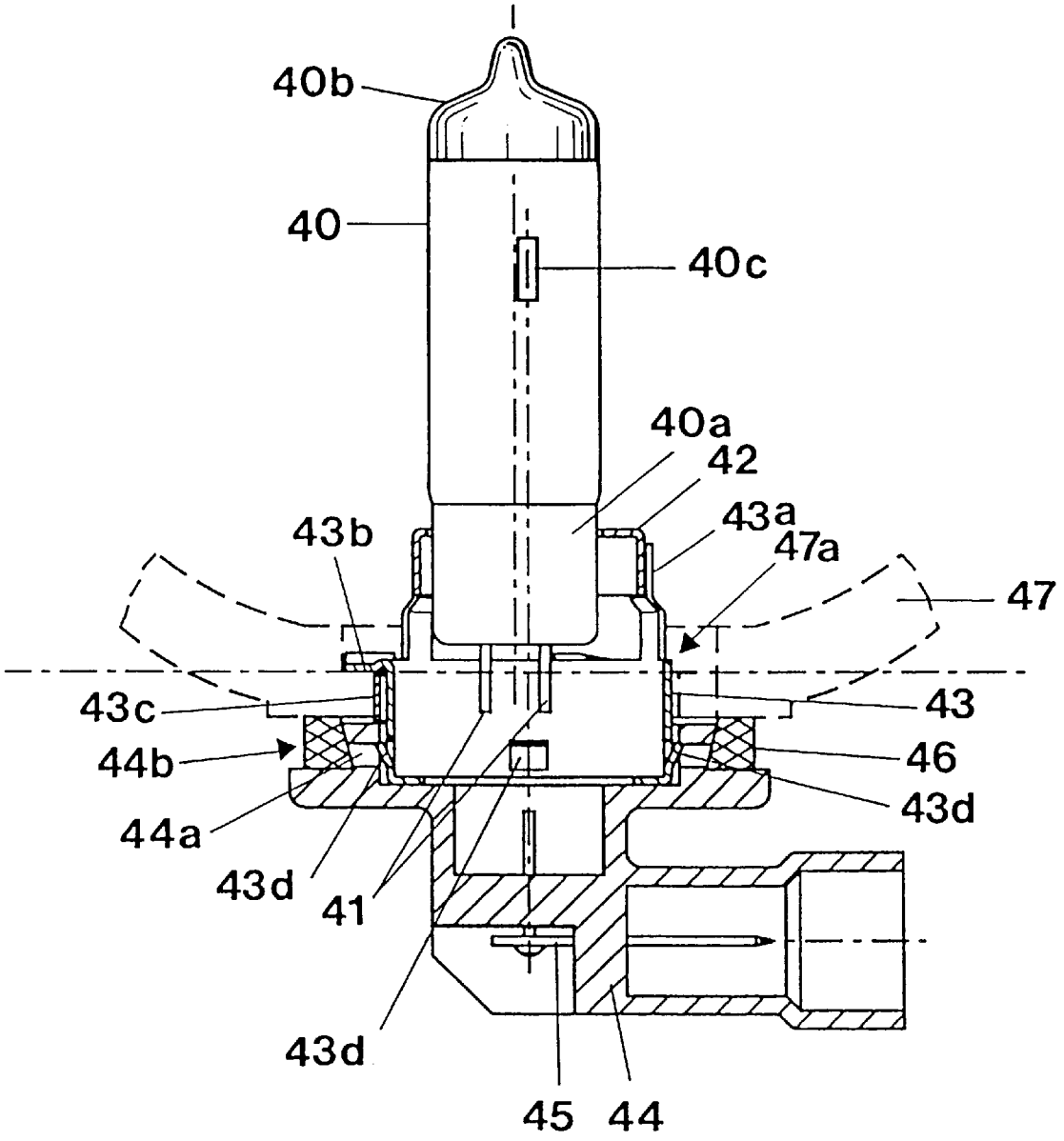
FIG. 6 shows a schematized side view of a third alternative electric lamp, based without cement, in partially sectional representation.

FIG. 6 shows a fourth preferred embodiment of the invention, again relating to a single-filament incandescent halogen lamp for installation in the reflector of a motor-vehicle headlight. This lamp has an essentially cylindrical glass lamp bulb 40 with a pinch-sealed lamp-bulb end 40*a* which is generally referred to as the pinch end 40*a*. The dome 40*b* of the lamp bulb 40 is provided with a black light-absorbing coating. The light source used is an incandescent filament 40*c*, aligned parallel to the axis of the lamp bulb, which is electrically connected to electrical supply leads 41 led out from the pinch end 40*a*. The lamp bulb 40 is fastened via its pinch end 40*a* in a metal holder part 42 designed as a fastening ring. The fastening ring 42 is supported by an annular metal support sleeve 43. The support sleeve 43 has four integrally formed welding tabs 43*a*, which are spot-welded to the fastening ring 42. In addition to the metal fastening ring 42 and the metal support sleeve 43, the lamp base also has a plastic base part 44 which is provided with electrical connections 45 of the lamp and in which the support sleeve 43 is anchored. The electrical connections 45 of the lamp are each welded to one of the electrical supply leads 41. The plastic base part 44 is an injection-molded part, into which the metal support sleeve 43 is fitted. The support sleeve 43 is equipped with a plurality of integrally formed barbs 43*d* which irremovably hook into recesses 44*a*, matched to the barbs 43*d* inside the plastic base part 44, when the support sleeve 43 is fitted into the plastic base part 44. The metal support sleeve 43 furthermore has three integrally formed reference lugs 43*b* which are formed at an angle to the support sleeve 43. These reference lugs 43*b* are arranged equidistantly along a circumference and are used for aligning the incandescent filament 40*c* and for fastening the lamp in the reflector 47.

The plastic base part 44 has an annularly extending, tapered groove 44*b* in which a rubber or silicone gasket 46 is arranged. The gasket 46 bears on the outside of the reflector wall 47 and seals off the reflector opening 47*a*. The internal diameter of the gasket 46 is accurately matched to the tapered groove 44*b* and varies linearly with the gasket height. The plastic base part 44 is plugged with a sealing compound which seals off the lamp base at the electrical supply leads 41. The three reference lugs 43*b*, the gasket 46 and a pressure spring 43*c*, integrally formed below a reference lug 43*b* on the metal support sleeve 43, are used for fastening the lamp in the lamp socket 47*a* of the reflector. The lamp base and the lamp socket 47*a* form a bayonet connection. To install the lamp in the reflector, the lamp is inserted, with the lamp bulb 40 forwards, into the reflector opening 47*a*, the three reference lugs 43*b* each engaging through a matched recess in the edge of the opening 47*a*. The lamp is then rotated in the lamp socket until it meets a stop, so that the reflector wall 47 is clamped between the reference lugs 43*b* and the gasket 46. The pressure spring 43*c* bears resiliently on the edge of the reflector opening 47*a*. To prevent erroneous installation of the lamp in the reflector, one of the three reference lugs 43*b* has a different shape from the other two reference lugs 43*b*. The same is also true for the recesses in the opening 47*a*, which are matched to the reference lugs 43*b*. Details of example pressure springs, such as pressure spring 43*c*, are represented in FIGS. 7 and 8 by springs 70 and 80.

In contrast to the first two embodiments, the plastic base part 44, is provided with the electrical connections 45 of the lamp, as in the third preferred embodiment, does not enter into the opening 47*a* of the reflector 47. However, unlike in the third embodiment, in this fourth embodiment the plastic parts are completely outside the opening 47*a*, to reduce the risk of the inside of the reflector wall 47 being fogged by the vapors being given off by the plastic lamp parts. In this fourth embodiment, the plastic reference lugs in embodiments one to three are replaced by metal reference lugs 43*b*.

FIGS. 7 and 8 show two different embodiments of the pressure spring (see items 13*c*, 23*c*, 33*c*, 43*c*) fitted on the metal support sleeve. The embodiment of the pressure spring shown in FIG. 7 can be applied to all four above-mentioned preferred embodiments, while the embodiment of the pressure springs represented in FIG. 8 can only be used in preferred embodiments 1 to 3.

FIG. 7 shows a cross-section through the lamp cap, in a plane perpendicular to the axis of the lamp and extending through the pressure spring. The pressure spring 70 is designed as a bent leaf spring and is provided with planar ends 70*a* and 70*b* that are arranged equidistantly along the outer wall of the annular metal support sleeve 71. On one side, the pressure spring 70 is welded via the planar end 70*b* onto the outer wall of the support sleeve 71, while the other end 70*a* of the pressure spring 70 bears loosely on the outer wall of the support sleeve 71, so that the end 70*a* slides on the outer wall of the support sleeve 71 when pressure is exerted on the outwardly bent region 70*c* of the pressure spring 70. In the region of the pressure spring 70, the annularly designed support sleeve 71 in each case has a plane, that is to say not bent, region 71 a on which the ends 70*a*, 70*b* of the pressure spring 70 bear. The support sleeve 71 is anchored in the plastic base part 72. The outwardly bent region 70*c* of the pressure spring 70 bears on the edge of the reflector opening, after the lamp has been installed in the reflector.

FIG. 8 shows a second embodiment of the pressure spring, in a cross sectional plane through the lamp cap, perpendicular to the axis of the lamp and extending through the pressure spring. Here again, the pressure spring 80 is designed as an outwardly bent leaf spring. The two ends 80*a*, 80*b* of the leaf spring 80 are each inserted into hollow recesses 82*a*, 82*b* between the metal support sleeve 81 and the plastic base part 82. The outwardly bent region 80*c* of the leaf spring 80 protrudes from the outer wall of the annular support sleeve 81. When pressure is exerted on the bent region 80*c* of the leaf spring 80, the leaf-spring ends 80*a*, 80*b* slide deeper into the hollow recesses 82*a*, 82*b*. The outwardly bent region 80*c* of the pressure spring 80 bears on the edge of the reflector opening, after the lamp has been installed in the reflector. In all preferred embodiments, the pressure spring consists of a spring steel.

Figure 9:
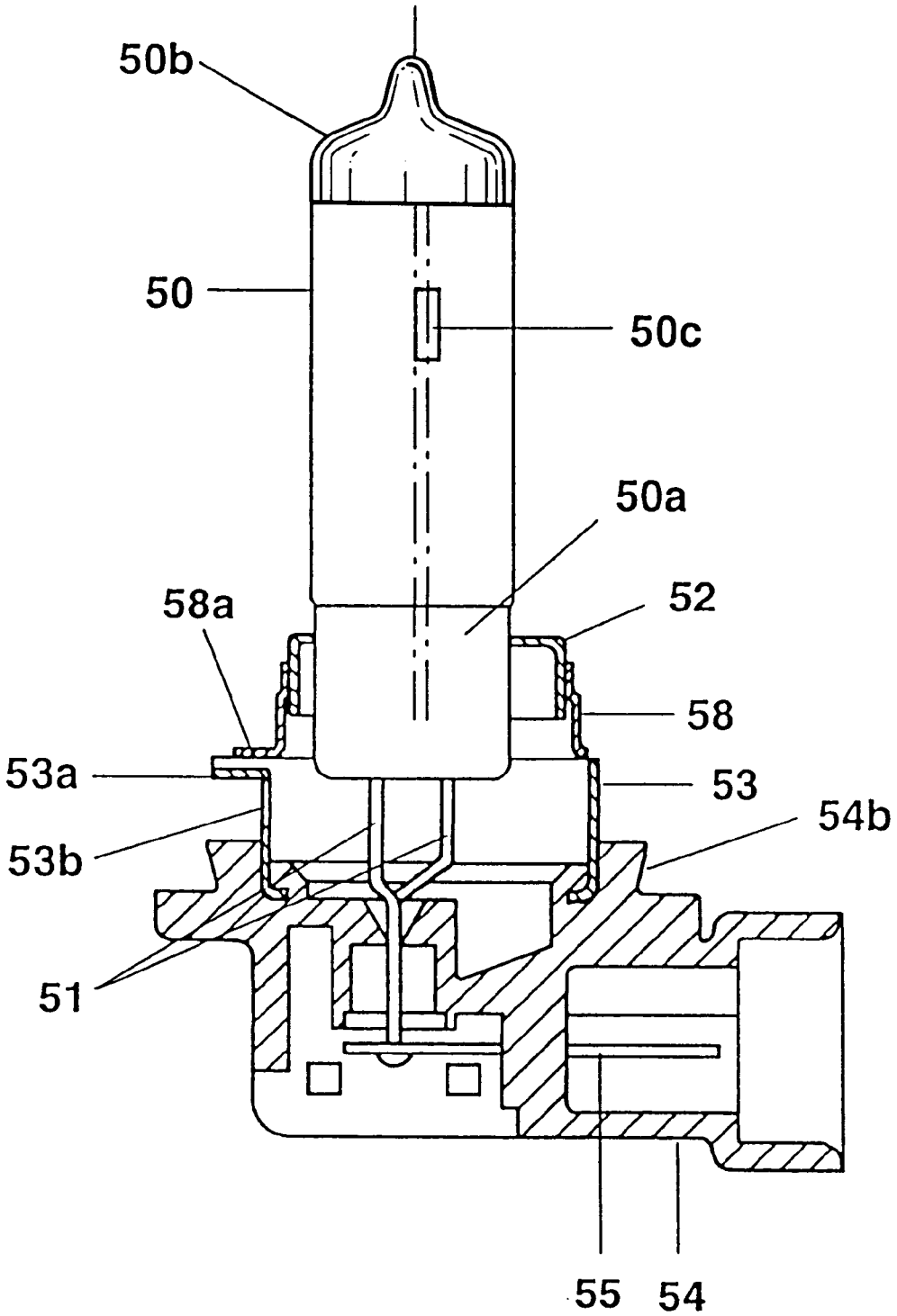
FIG. 9 shows a schematized side view of a fourth alternative electric lamp, based without cement, in partially sectional representation.
Figure 10:
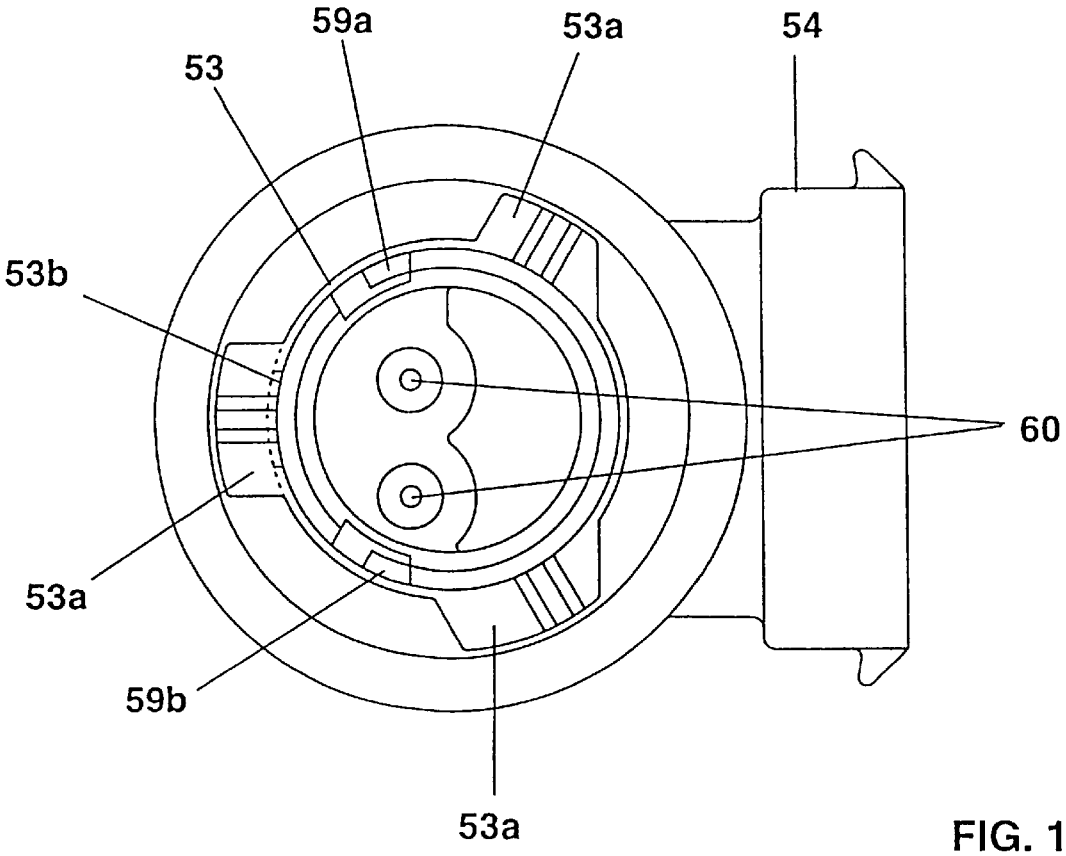
FIG. 10 shows a plan view of the plastic base part into which the support sleeve is injected.
Figure 11:
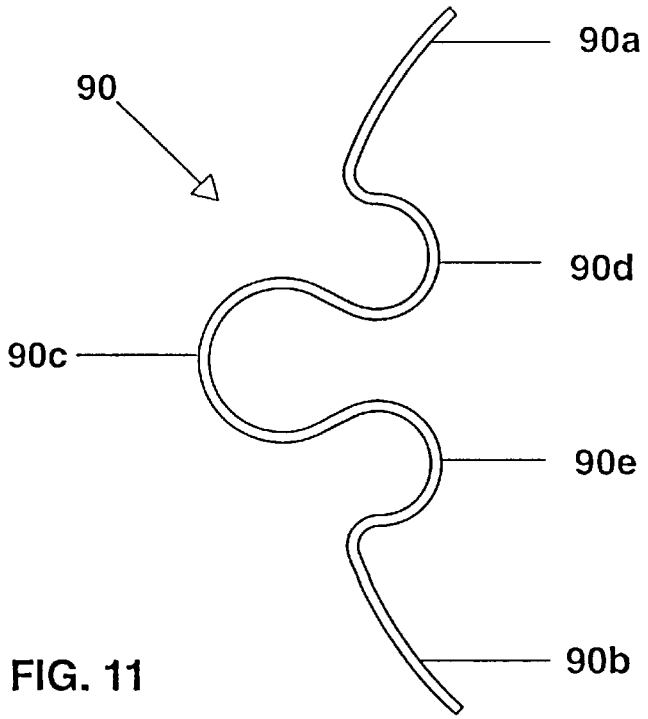
FIG. 11 shows a side view of the pressure spring in FIG. 10.

FIGS. 9 to 11 show a fifth preferred embodiment of the invention. This embodiment of the lamp based without cement is also a single-filament incandescent halogen lamp, to be used in a motor-vehicle headlight. This lamp has an essentially cylindrical glass lamp bulb 50 with a pinch-sealed lamp-bulb end 50*a* which is referred to as the pinch end 50*a*. The dome 50*b* of the lamp bulb 50 is provided with a black, light-absorbing coating. The light source used is an incandescent filament 50*c*, aligned parallel to the axis of the lamp bulb and electrically connected to electrical supply leads 51 led out from the pinch end 50*a*. The lamp bulb 50 is fixed via its pinch end 50*a* in a metal holder part 52 designed as a fastening ring. The fastening ring 52 is supported by a metal intermediate ring 58 which is provided with three integrally formed welding tabs 58*a*, preferably formed at an angle thereto. The intermediate ring 58 in turn is laser-welded to a metal support sleeve 53. In addition to the metal fastening ring 52, the intermediate ring 58, and the metal support sleeve 53, the lamp base also has a plastic base part 54 which is provided with the electrical connections 55 of the lamp and in which the support sleeve 53 is anchored. The electrical connections 55 of the lamp are each welded to one of the electrical supply leads 51. The plastic base part 54 is an injection-molded part into which the metal support sleeve 53 is injected.

The support sleeve 53 has three integrally formed reference lugs 53*a*, arranged equidistantly along a circumference which are used for aligning the incandescent filament 50*c* and for fastening the lamp in the reflector (not shown in FIG. 9) of the headlight. The reference lugs 53*a* are formed at an angle to support sleeve 53 and lie in a common plane. The welding tabs 58*a* of the intermediate ring 58 are laser-welded to the reference lugs 53*a*. The intermediate ring 58 provides additional possibilities for alignment in the reference plane defined by the reference lugs 53*a*.

The plastic base part 54 has an annularly extending, tapered groove 54*b*, in which a rubber or silicone gasket (not shown in FIG. 9) is arranged. The gasket bears on the outside of the reflector wall and seals off the reflector opening. The internal diameter of the gasket in this embodiment is also accurately matched to the tapered groove 54*b* and varies linearly with the gasket height. A bent leaf spring 90 (FIG. 11), used to fasten the lamp in the headlight, projects through a passage 53*b*, located below one of the three reference lugs 53*a*, in the wall of the annular support sleeve 53. The ends 90*a*, 90*b* of the leaf spring 90 bear on the inner wall of the support sleeve 53 and on a first stop 59*a*, and a second stop 59*b*, each integrally formed on the plastic base part 54, so that the leaf spring 90 is clamped between the first stop 59*a*, and second stop 59*b* formed as holders.

The three reference lugs 53*a*, the gasket arranged in the groove 54*b* and a pressure spring 90 are used for fastening the lamp in the lamp socket of the reflector. The lamp base and the lamp socket form a bayonet connection. To install the lamp in the reflector, the lamp is inserted, with the lamp bulb 50 forwards, into the reflector opening, the three reference lugs 53*a* each engaging through a matched recess in the edge of the opening. The lamp is then rotated in the lamp socket until it meets a stop, so that the reflector wall is clamped between the reference lugs 53*a* and the gasket as described in the fourth preferred embodiment as shown in FIG. 6. The pressure spring 90 bears resiliently on the edge of the reflector opening. To prevent erroneous installation of the lamp in the reflector, the three reference lugs 53*a* all have different shapes. The same is also true for the recesses in the opening which are matched to the reference lugs 53*a*. Details of the pressure spring 90 are represented in FIG. 11.

The pressure spring according to the fifth preferred embodiment is formed as a bent leaf spring. It has two slightly curved ends 90*a*, 90*b* which, after being assembled, bear on the inner wall of the annular support sleeve. The leaf spring 90 is fixed in position moreover by first stop 59*a*, and the second stop 59*b*, integrally formed on the plastic base part 54, on which the ends 90*a*, 90*b* meet. As a result the leaf spring 90 is clamped between first stop 59*a*, and the second stop 59*b* (FIG. 10). The leaf spring has a region 90*c* bulging outwards in bulbous fashion which projects through the passage 53*b* in the support sleeve 53 after fitting of the leaf spring 90 and bears on the reflector opening designed as the lamp socket after fitting of the lamp in the headlight. In the plan view of FIG. 10 the passage 53*b* is shown in broken lines only, since it is covered by one of the reference lugs 53*a*. The outwardly bent region 90*c* of the leaf spring 90 is connected by two inwardly bent regions 90*d* and 90*e* to the respective leaf spring ends 90*a* and 90*b*. The reference numeral 60 in FIG. 10 denotes the passages for the electrical supply leads 51 of the lamp in the plastic base part 54.

The invention is not restricted to the preferred embodiments described in detail above. By way of example, the lamp base according to the invention can also be applied to two-filament incandescent halogen lamps and to high-pressure discharge lamps, which are intended to be used in motor-vehicle headlights.

What is claimed is:

1. An electric lamp base for holding a lamp bulb without cement, comprising a lamp base which has a metal holder part to hold the bulb, a metal support sleeve, connected to the metal holder part, and a plastic base part which is provided with electrical connections for the bulb and in which the metal support sleeve is anchored, the lamp base having a plurality of reference lugs lying in a plane, the support sleeve, the metal cover tabs being positioned to cover the reference lugs so that the plastic reference lugs are screened by the cover tabs from the electromagnetic radiation generated by the lamp.

2. The electric lamp base according to claim 1, wherein the metal cover tabs cover the sides of the reference lugs facing the lamp bulb.

3. The electric lamp based according to claim 1, further including an intermediate ring forming a portion of the support sleeve, the intermediate ring provided with integrally formed, projecting welding tabs, and wherein in the holder part is connected to the metal support sleeve by welding the welding tabs of the intermediate ring to the cover tabs of the metal support sleeve.

4. The electric lamp base according to claim 1, wherein the metal support sleeve has a annular form, with an exterior wall and the metal support sleeve is provided with at least one pressure spring positioned along the exterior wall.

5. An electric lamp base for holding a lamp bulb without cement, comprising:

a metal holder part to hold the bulb, a metal support sleeve, connected to the metal holder part, and a plastic base part which is provided with electrical connections for the bulb and in which the metal support sleeve is anchored, the lamp base having a plurality of reference lugs lying in a plane, and wherein the reference lugs are made of metal and are form integrally with the metal support sleeve.

6. The electric lamp base according to claim 5, wherein the metal support sleeve has an annular form with a radially exterior wall, and the metal support sleeve is provided with at least one pressure positioned along the exterior wall.

7. The electric lamp base according to claim 6, wherein the at least one pressure spring is a bent leaf spring with a first end and a second end.

8. The electric lamp base according to claim 7, wherein the plastic base part has a first holder and a second holder between which the first end and the second end of the at least one leaf spring are clamped, and the support sleeve has a passage in which the at least one leaf spring is engaged.

9. The electric lamp base according to claim 6, wherein the at least one pressure spring is a bent leaf spring with a first end and a second end, the first end of the pressure spring being welded to the metal support sleeve, the second end bearing on the support sleeve such that the second end can slide, and wherein the leaf spring bears resiliently on an edge of a socket defining a socket opening after the lamp base is fitted into the socket opening.

10. The electric lamp base according to claim 6, wherein the at least one pressure spring is a bent leaf spring with a first end and a second end, the first end and the second end of the leaf spring each being arranged respectively in recesses between the metal support sleeve and the plastic base part, so that the leaf spring bears resiliently on the edge of a socket defining a socket opening, after the lamp is fitted into the socket opening.

11. The electric lamp base according to claim 7, wherein the plastic base part has a first holder and a second holder between which the first end and the second end of the at least one leaf spring are clamped, and the support sleeve has a passage in which the at least one leaf spring engages.

12. The electric lamp base according to claim 11, wherein the support sleeve has an inner wall, the first end the second end of the at least one leaf spring bear on the inner wall of the support sleeve, the at least one leaf spring has an outwardly bent region which engages in the passage, and the at least one leaf spring has two inwardly bent regions which respectively connect the outwardly bent region to the first end and the second end.

13. The electric lamp base according to claim 6, wherein the pressure spring is made of a spring steel.

14. The electric lamp base claim 5, further including an intermediate ring provided with integrally formed, projecting welding tabs, wherein the holder part is connected to the metal support sleeve via the intermediate ring by welding the welding tabs of the intermediate ring to the reference lugs of the metal support sleeve.

15. The electric lamp base according to claim 1, wherein the plastic base part has an annularly extending, tapered groove for receiving a gasket.

16. The electric lamp base according to claim 5, wherein the plastic base part has an annularly extending, tapered groove for receiving a gasket.

17. The electric lamp base according to claim 16, wherein the gasket has an internal diameter, and the diameter is accurately matched to the tapered groove and varies linearly with the height of the gasket.

18. An electric lamp base and reflector assembly, comprising:

a reflector including a wall and being provided with an interior edge defining an opening made in the reflector wall, a lamp having a bulb and a lamp base which has a metal holder part in which the bulb is fixed, the lamp base having a metal support sleeve connected to the metal holder part, and a plastic base part which is provided with electrical connections for bulb and in which the metal support sleeve is anchored, the lamp base part having a plurality of reference lying in a plane, the lugs being used for holding and for correct installation of the lamp in the reflector, wherein the plastic reference lugs engage with the reflector opening, and the metal support sleeve has the same number of metal cover tabs as the lamp base part has reference lugs, the cover tabs being positioned to cover the reference lugs so that the plastic reference lugs are screened by the cover tabs against electromagnetic radiation generated by the lamp.

19. An electric lamp and reflector assembly, comprising:

a reflector having a wall and provided with an interior edge defining an opening made in the reflector wall, a lamp bulb, a lamp base which has a metal holder part to hold the bulb, the lamp base having a metal support sleeve connected to the metal holder part and a plastic base part which is provided with electrical connections for the lamp and in which the metal support sleeve is anchored, the lamp base having a plurality of reference lugs lying in a plane, the lugs being used for holding and for correct installation of the lamp in the reflector, wherein the reference lugs are made of a metal and are formed integrally with the metal support sleeve, and the reference lugs engage in the reflector opening.

20. The electric lamp base and reflector according to claim 18, wherein the metal support sleeve has an annular form, with a sleeve diameter and the reflector opening has an engagement diameter, the sleeve diameter is matched to the engagement diameter of the reflector opening, and the metal support sleeve is provided with at least one pressure spring which bears on interior edge of the reflector after the lamp has been fitted in the reflector opening.

21. The electric lamp base and reflector according to claim 19, wherein the metal support sleeve has an annular form with a sleeve diameter, and the reflector opening has an engagement diameter, the sleeve diameter is matched to the engagement diameter of the reflector opening, and the metal support sleeve is provided with at least one pressure spring which bears on the interior edge of the reflector after the lamp has been fitted in the reflector opening.

* * * * *